United States Patent [19]

Camm

[11] Patent Number: 4,683,525

[45] Date of Patent: Jul. 28, 1987

[54] LAMP HAVING SEGMENTED REFLECTOR

[75] Inventor: David M. Camm, Vancouver, Canada

[73] Assignee: Fusion Systems Corporation, Rockville, Md.

[21] Appl. No.: 928,649

[22] Filed: Nov. 5, 1986

Related U.S. Application Data

[63] Continuation of Ser. No. 707,159, Mar. 1, 1985, abandoned.

[30] Foreign Application Priority Data

Mar. 1, 1984 [JP] Japan ..... 59-39719

[51] Int. Cl.[4] ..... F21V 7/00

[52] U.S. Cl. ..... 362/346; 362/297

[58] Field of Search ..... 362/346, 297, 301, 348, 362/350, 305, 349

[56] References Cited

U.S. PATENT DOCUMENTS

| | | | |
|---|---|---|---|
| 1,235,274 | 7/1917 | Wood | 362/346 |
| 1,610,124 | 12/1926 | Godlay | 362/297 |
| 1,732,884 | 10/1929 | Foster | 362/297 |
| 1,737,027 | 11/1929 | Schoonmaker | 362/297 |
| 1,759,720 | 5/1930 | Stitzer | 362/297 |
| 2,341,658 | 2/1944 | Salani | 362/297 |
| 4,417,300 | 11/1983 | Bodmer | 362/346 |

FOREIGN PATENT DOCUMENTS

| | | | |
|---|---|---|---|
| 102931 | 3/1984 | European Pat. Off. | 362/297 |
| 2082745 | 3/1942 | United Kingdom | 362/297 |
| 2111186 | 6/1983 | United Kingdom | 362/297 |

*Primary Examiner*—Raymond A. Nelli

*Attorney, Agent, or Firm*—Pollock, Vande Sande and Priddy

[57] ABSTRACT

A lamp comprised of a light source and reflector wherein the reflector is comprised of a plurality of annular segments which are arranged with respect to the source and a target to be irradiated so that points on the target receive radiation which is reflected from a different number of segments with points on the target which are closer to the periphery thereof receiving radiation which is reflected from a greater number of segments then points which are closer to the center of the target in such manner that due to the increase in target area in a direction from the target center to periphery the radiation incident across the entire target area is substantially uniform, and whereby the average local divergence of radiation incident on the target is minimized and spatial non-uniformities are relatively averaged.

14 Claims, 5 Drawing Figures

LAMP HAVING SEGMENTED REFLECTOR

This application is a continuation of application Ser. No. 707,159, filed Mar. 1, 1985, now abandoned.

The present invention is directed to an improved lamp for providing relatively uniform radiation at a target plane at a relatively small local divergence.

Many applications for optical equipment require that relatively uniform radiation across the extent of a target plane be provided. For some applications, for example, photolithography, it is also desirable that the radiation at the target plane be of small local divergence, where local divergence is defined as the solid angle subtended by the source, as seen from points on the target.

In photolithography, light is projected from a lamp through a mask or transparency at a target plane, behind which a photosensitive medium is disposed. It is desirable for the projected light to be uniform so that the areas of varying transparency of the mask are truly recorded on the photosensitive medium. It is also desirable for the light to have a small local divergence so that the resolution of the image on the mask is substantially maintained when the image is projected on the photosensitive medium.

In some prior art photolithography systems, as shown in Japanese laid open Patent Application No. 58-35861, refractive optics are employed to attempt to make the projected light uniform. However, such systems do not have a small local divergence, as the divergence of such systems measured at the center of the target plane is approximately the same relatively large angle as the divergence at the edge of the target. Accordingly, such prior art systems may not achieve the desired resolution at the photosensitive medium.

It is thus an object of the present invention to provide a lamp which projects relatively uniform radiation over the extent of a target plane.

It is a further object of the invention to provide a lamp which projects light having a relatively small local divergence on a target plane.

It is still a further object of the invention to provide a lamp having a relatively high efficiency.

It is still a further object of the invention to provide a lamp which is especially suited for photolithography.

It is still a further object of the invention to provide a lamp which attains the above objects using an electrodeless light source.

The above objects are accomplished by providing a lamp utilizing a segmented reflector. The segments are arranged with respect to the light source and the target plane so that each segment reflects light emitted by a different portion of the source and so that points on the target plane receive radiation which is reflected by a number of different segments of the reflector. Hence, the radiation on the target is averaged over many portions of the source and reflector and the radiation on the target is relatively independent of source and reflector non-uniformities. For example, in the preferred embodiment, the lamp of the invention utilizes an electrodeless light source which requires a slot in the reflector for coupling microwave energy, and due to the above-mentioned averaging effect, the slot casts only a small dark spot on the target, instead of a larger discontinuity as would be produced by more conventional optics.

Further, the segments of the reflector are arranged to result in a small local divergence at the target plane, resulting in improved resolution. The center of the target is illuminated by direct radiation from the source and by radiation reflected from only one segment while the middle of the target is irradiated by radiation reflected by a number of reflector segments, and the edge of the target is irradiated by radiation which is reflected by all of the reflector segments. Hence, the local divergence at the center is smallest, and increases towards the edges, resulting in a relatively small average local divergence as compared with other optical systems.

The invention will be better understood by referring to the accompanying drawings in which.

Figure 1:
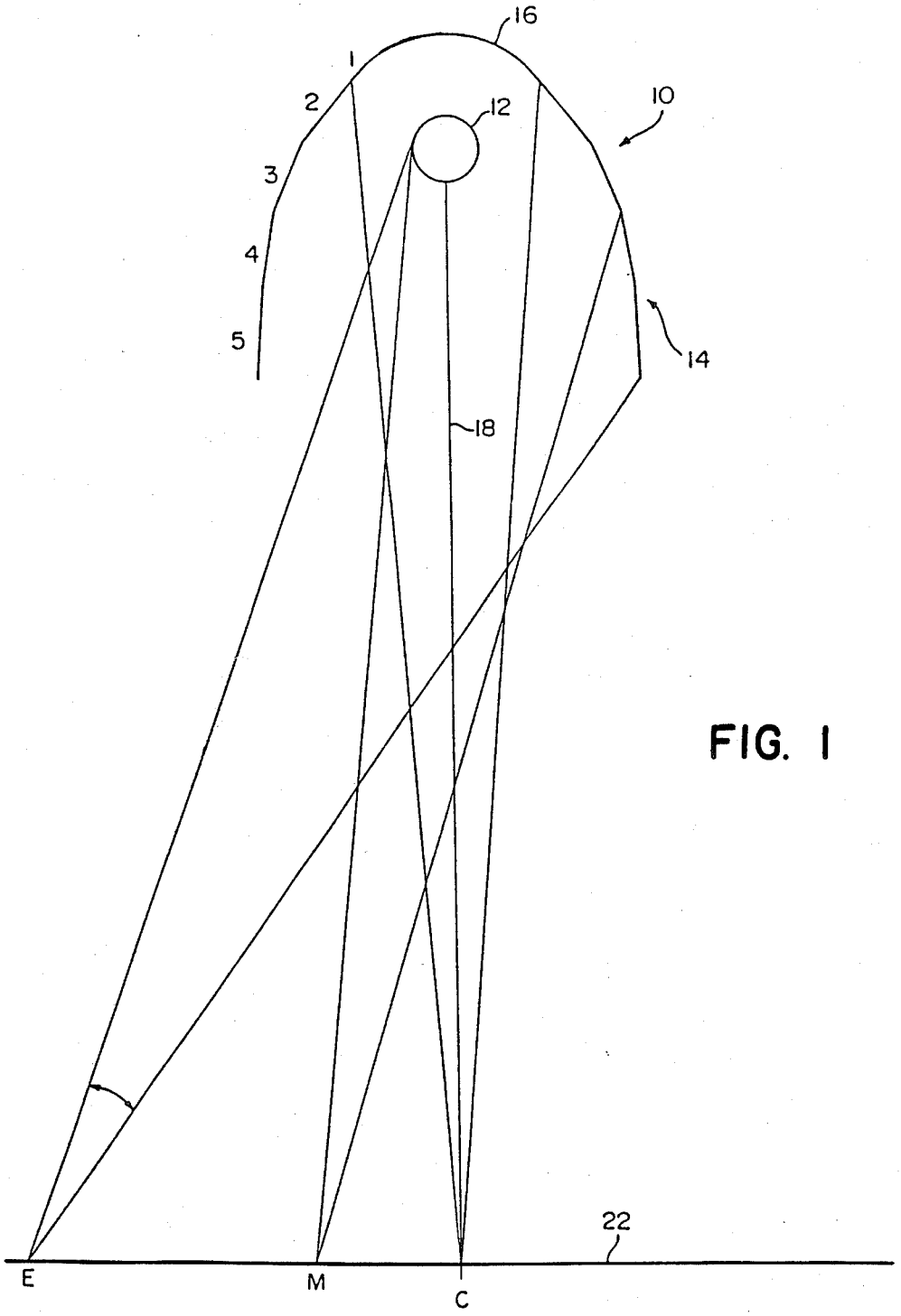
FIG. 1 is a schematic illustration of an embodiment of the lamp of the invention including a ray diagram which illustrates how relative uniformity and small local divergence are produced.

Referring to FIG. 1, lamp 10, which is comprised of light source 12 and reflector 14 is shown. In the embodiment of FIG. 1, light source 12 is an electrodeless light source which is spherical in shape, although in other embodiments, different sources may be used. An electrodeless light source is a volume emitter, which emits light from the volume of an excited gas which is contained within a lamp bulb.

Figure 2:
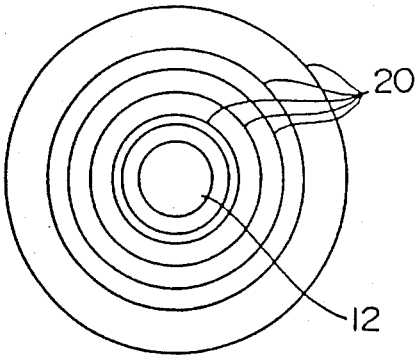
FIG. 2 is a bottom view of the lamp of FIG. 1.

Reflector 14 is comprised of spherical portion 16 and segments 1 to 5. Each segment defines an annular band around axis 18, with each being flat, or rectangular in cross section as schematically shown in FIG. 1. A bottom view of the lamp of FIG. 1 is shown in FIG. 2, wherein lines 20 represent the interstices of the segments. As seen in the figures, the reflector is rotationally symmetrical with respect to an axis passing through the light source and perpendicular to the target plane.

Spherical portion 16 of the reflector reflects light back into the spherical source, and thus this portion may be coated with light absorbing material while each segment of the reflector is coated with reflecting material.

It is seen that target 22 is marked with the letter C, denoting the center of the target, the letter M, denoting a point somewhere in the middle of the target, and the letter E, denoting a point on the edge of the target. Referring to the ray diagram in FIG. 1, the center of the target is irradiated with light emitted directly by source 12 and also by light which is reflected from segment 1.

Point M on the target is irradiated with light which is reflected from segments 1 to 3, while point E is irradiated with light which is reflected from all of segments 1 to 5. Thus, points on the target plane are irradiated with light from more than one segment, and the radiation incident on the target plane is therefore relatively independent of local light source output variations and reflector non-uniformities. This is so because the different reflector segments reflect light emitted from different areas of the light source, and local source and reflector non-uniformities are averaged out in the light which is incident on the target.

As discussed above, it is desired for the local divergence of the lamp at the target plane to be as small as possible. In a photolithography system, a transparency is situated at the target plane, and the converging cone of rays which is incident on each point of the transparency begins to diverge after crossing the target plane. The local divergence is defined as the solid angle subtended by the source as seen from the target plane, and it is seen that the smaller the local divergence, the smaller will be the diameter of the diverging bundle of rays as it is incident on the photosensitive surface which is located below the target plane in FIG. 1, and the greater the resolution will be of the image which is projected on the photosensitive surface.

Referring to the figure, the local divergence at point C is set by segment 1, while the local divergence at points M and E are set by the direct ray from the source and the last segment which reflects a ray to that point. Hence, as seen in the figure, the local divergence is a function of how many segments are irradiating a particular point on the target, with points towards the center being irradiated by fewer segments and having smaller local divergence than points at the edges. Thus, the average local divergence is substantially smaller than with the use of conventional optics, in which the divergence at the edge shown in FIG. 1 would be more nearly the average divergence across the target.

This has been dramatically illustrated by taking photographs of the lamp from various points on the target. A photograph taken at the center of the target shows a bright ring at segment 1, while a photograph taken from point E shows light emanating from all of the segments. The situation at point E represents the extent of the divergence which would be present even at the center of the prior art system.

In the embodiment of FIG. 1, the segments are arranged to provide minimum average local divergence, and the aiming of the majority of segments so that they cross the axis gives a small diameter to the reflector mouth. Additionally, for most target points, since all segments that contribute to a given point on the target are grouped to one side of the reflector, the solid angle subtended by the source is kept to a minimum.

Figure 3:
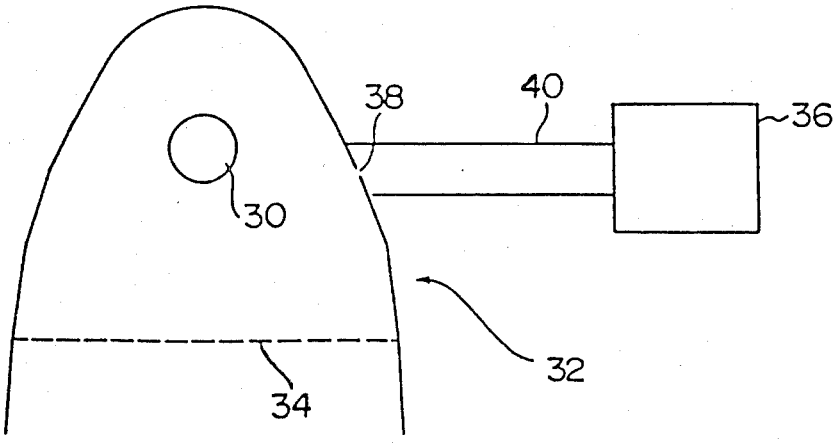
FIG. 3 is a more complete illustration of a preferred embodiment of the invention utilizing an electrodeless light source.

FIG. 3 is an illustration of a microwave generated electrodeless lamp which utilizes the present invention. Referring to the figure, light source 30 and reflector 32 are as shown in FIGS. 1 and 2. Additionally, mesh 34 is disposed across the reflector to provide a microwave chamber which contains microwave energy but allows emitted ultraviolet or visible light to exit. Microwave energy is generated by magnetron 36 and is fed to slot 38 in the reflector wall by waveguide 40.

An advantage of the invention is that slot 38 does not cast a significant dark spot on the target as would be expected with conventional optics. The reason for this is as discussed above, that points on the target receive averaged radiation which is reflected from a number of segments.

Figure 4:
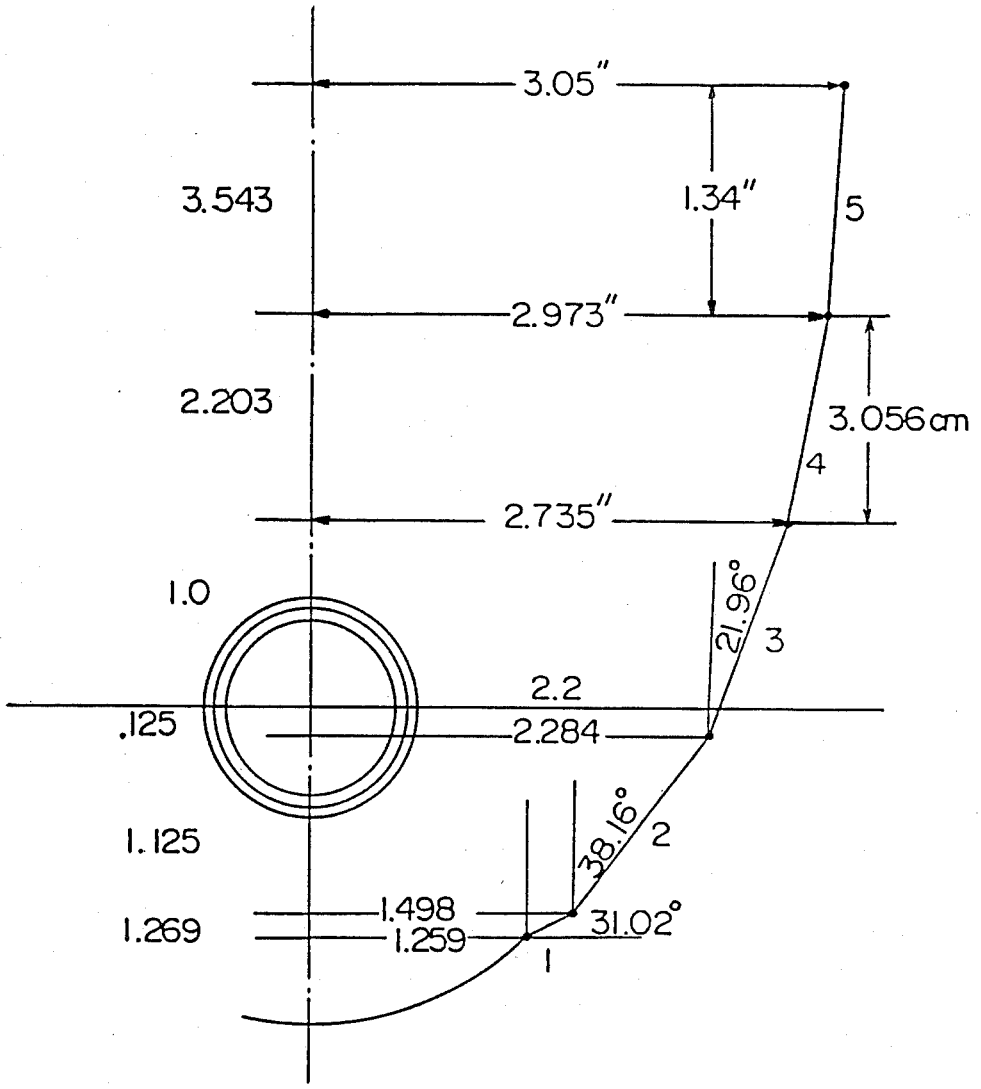
FIG. 4 is a detail of a preferred embodiment of the reflector of the invention.

FIG. 4 is a detailed illustration of the reflector, and shows the dimensions and angular dispositions of the annular segments in the preferred embodiment which provides minimum local divergence.

Figure 5:
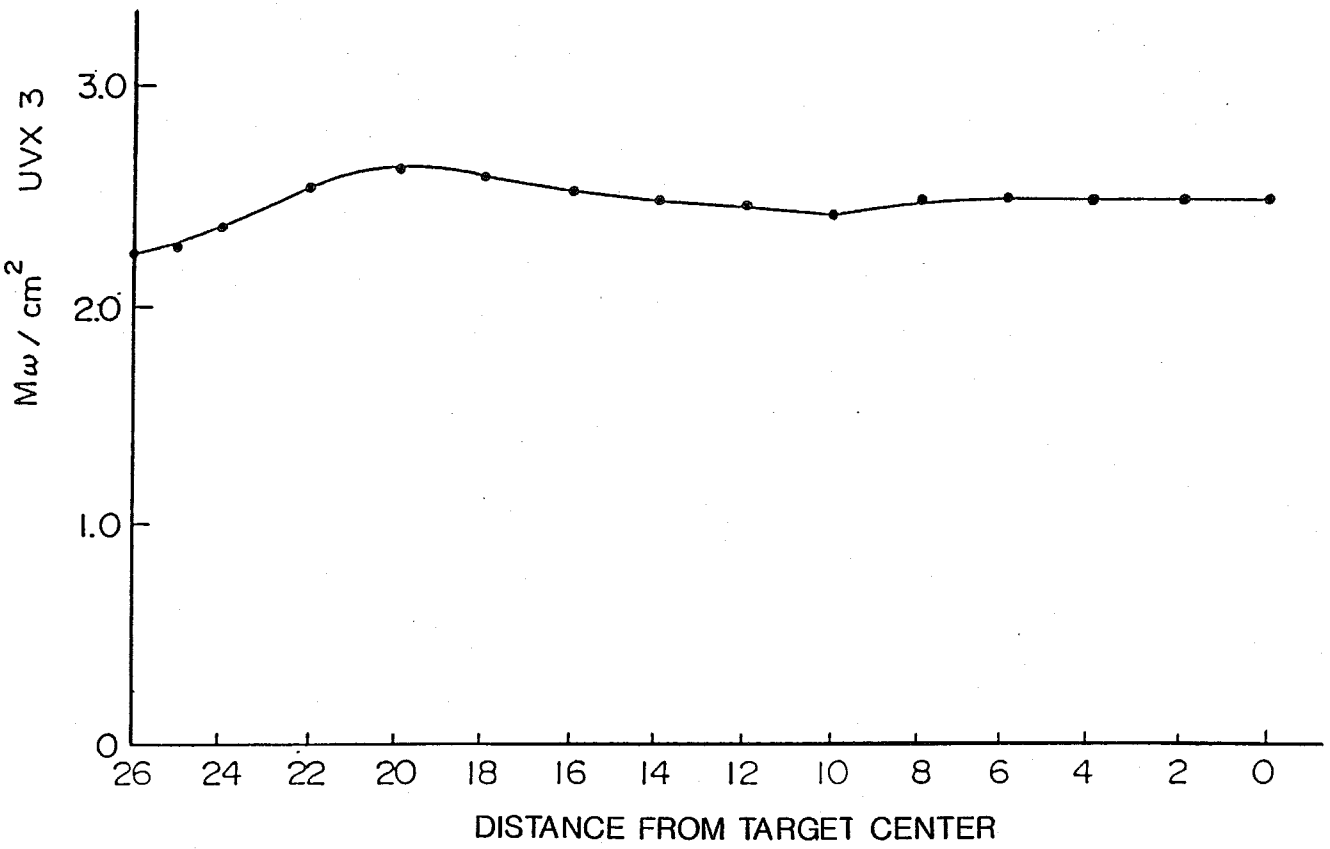
FIG. 5 is a graph illustrating radiation intensity as a function of target distance, and depicts the relative uniformity attained with the lamp of the invention.

FIG. 5 is a graph showing light intensity at the target plane as a function of distance from the center. The relatively level shape of the intensity plot illustrates that the goal of relatively uniform illumination is attained.

While the illustrative embodiment has been disclosed in connection with segments which are flat in cross-section, it is to be understood that curved segments could also be used, although results obtained may not be as good.

It is to be understood that while an illustrative embodiment on the invention utilizing a rotationally symmetrical reflector has been described above, other possible configurations will occur to those in the art, and the scope of the invention is to be limited only by the claims appended hereto and equivalents.

I claim:

1. A lamp for providing both substantially uniform light flux and small average local divergence over the extent of a target of variable transparency to be illuminated, comprising a light source for emitting radiation, and a reflector in which said light source is disposed, said reflector having an axis and being comprised of a plurality of annular reflecting segments which are symmetrical with respect to said axis and which are arranged with respect to said source and the area of a target of variable transparency to be illuminated so that the points on said target receive radiation which is reflected from a plurality of different segments with points on the target which are closer to the periphery thereof receiving radiation which is reflected from a greater number of segments then points which are closer to the center of the target in such manner that due to the increase in target area in the direction from the target center to periphery the radiation incident across the entire target area is substantially uniform, and whereby the radiation incident on the variable transparency target is averaged over the reflecting segments and the average local divergence of such radiation is minimized.

2. The lamp of claim 1 wherein first target points which are removed from the target center receive radiation from more reflecting segments than the target center, and wherein target points which are further removed from the target center than said first points receive radiation from more segments than said first points.

3. The lamp of claim 1 wherein said annular segments are flat.

4. The lamp of claim 1 wherein said light source is a volume emitter of radiation.

5. The lamp of claim 2 wherein said target receives direct radiation from said light source in addition to radiation which is reflected from said segments.

6. The lamp of claim 2 wherein said reflecting segments are arranged with respect to said source and target so that the center of the target is illuminated by only one segment, target points somewhat removed from the center are illuminated by two segments, and points further removed from said points illuminated by two segments are illuminated by three segments.

7. The lamp of claim 3 wherein the opening defined by said annular segments is circular.

8. The lamp of claim 4 wherein said light source is spherical in shape.

9. The lamp of claim 2 wherein said annular segments are flat.

10. The lamp of claim 2 wherein the opening defined by said annular segments is circular.

11. The lamp of claim 2 wherein said light source is a volume emitter of radiation.

12. The lamp of claim 11 wherein said light source is spherical in shape.

13. The lamp of claim 6 wherein the reflector has at least five segments.

14. The lamp of claim 13 wherein target points further removed from the center than those illuminated by three segments are illuminated by four segments, and those points further removed from the target center than those illuminated by four segments, are illuminated by five segments.

* * * * *